United States Patent [19]

Caldwell, Jr.

[11] Patent Number: 4,958,585

[45] Date of Patent: Sep. 25, 1990

[54] BOAT HULL

[75] Inventor: James D. Caldwell, Jr., Cloud, Fla.

[73] Assignee: Skeeter Products, Inc., Kilgore, Tex.

[21] Appl. No.: 217,472

[22] Filed: Jul. 11, 1988

[51] Int. Cl.[5] ..... B63B 1/18

[52] U.S. Cl. ..... 114/271; 114/52; 114/291

[58] Field of Search ..... 114/56, 271, 290, 291

[56] References Cited

U.S. PATENT DOCUMENTS

| | | | |
|---|---|---|---|
| D. 107,724 | 12/1937 | Luders | D12/300 |
| D. 219,484 | 12/1970 | Lott | D12/300 |
| D. 244,840 | 6/1977 | Stokes | D12/300 |
| 3,162,167 | 12/1964 | Wynne | 114/290 |
| 3,216,389 | 11/1965 | Thorsen | 114/56 |
| 3,363,598 | 1/1968 | Mortrude | 114/290 |
| 4,263,866 | 4/1981 | Shirley | 114/56 X |
| 4,465,009 | 8/1984 | Wood et al. | 114/56 |
| 4,492,176 | 1/1985 | Arima | 114/271 X |

*Primary Examiner*—Sherman Basinger

[57] ABSTRACT

A boat hull is provided with a unique V-shaped bottom surface to increase lift, to reduce drag, and to maximize speed. The deadrise angle of the V-shaped bottom increases progressively from the stern to a point forward of the stern at a rate of 2° to 6° for each four feet of keel length, i.e., at the rate of about ½° to 1½° per foot of keel length. The bottom surface between the stern and the forward point has a generally convex transverse cross section. The keel is substantially straight from the stern to the forward point and then curves upwardly to the bow.

16 Claims, 2 Drawing Sheets

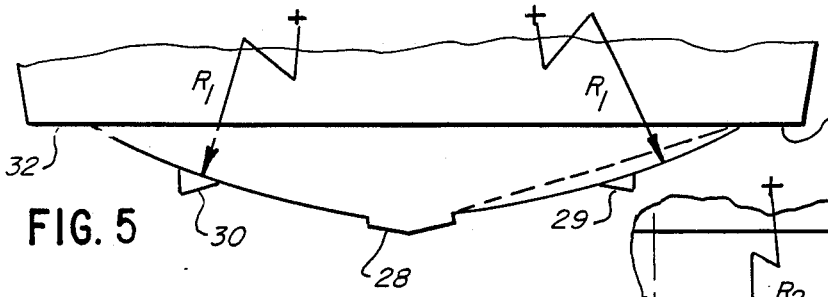
FIG. 5
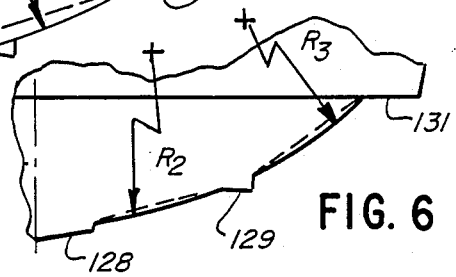
FIG. 6
FIG. 7
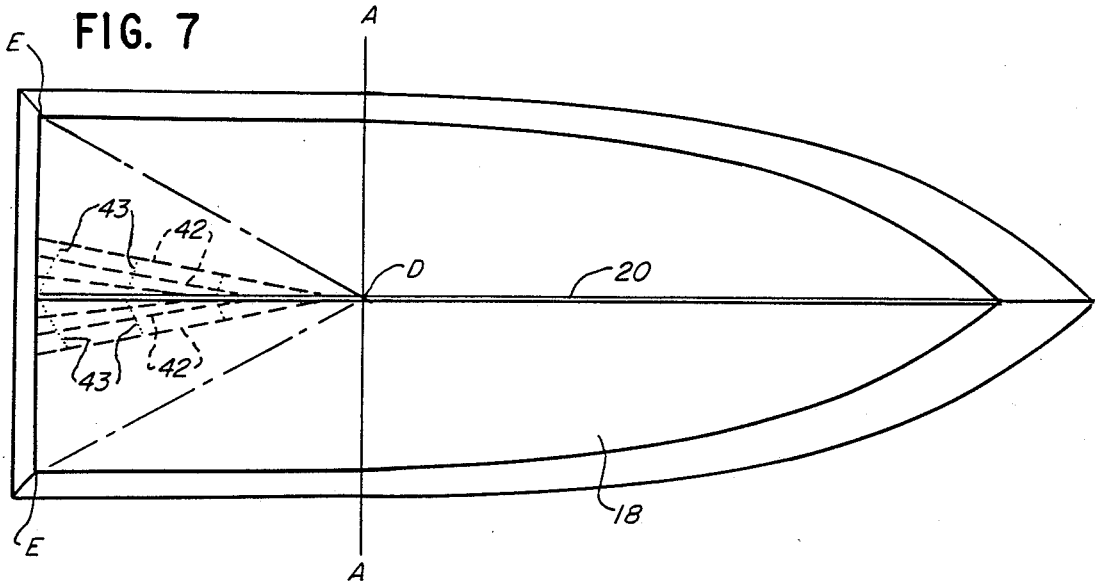
FIG. 8
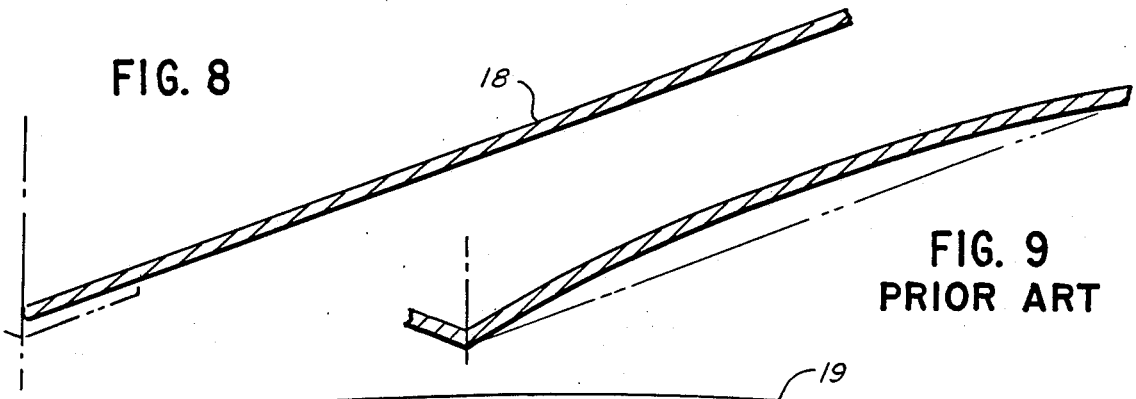
FIG. 9
PRIOR ART
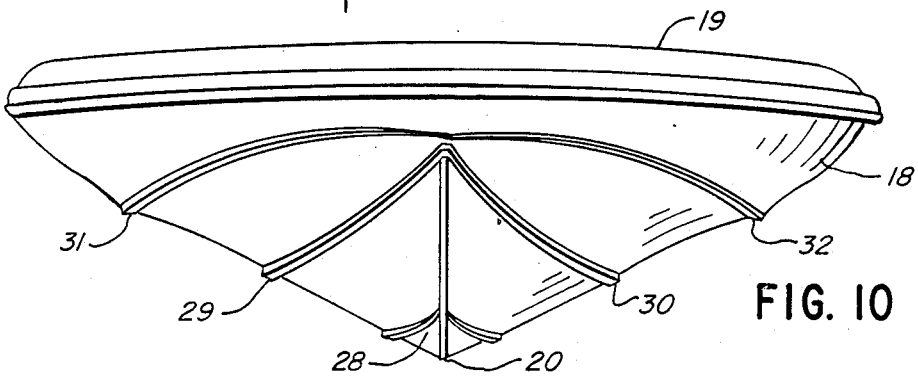
FIG. 10

BOAT HULL

BACKGROUND AND SUMMARY

This invention relates to a boat hull, and, more particularly, to a generally V-shaped boat hull which increases lift, reduces drag, and maximizes speed. The invention finds particular utility in hulls for high speed power boats. However, the invention is not limited to any particular type of boat and is applicable, e.g., to fresh water fishing boats, recreational boats, offshore boats, and other types of boats.

Many power boats are designed with a deep V hull to provide a comfortable ride and good handling characteristics. However, a major problem with deep V designs is that comfort and handling is attained at the cost of sacrificing high speed performance.

Increased speed is generally obtained by minimizing the drag of the hull and by increasing the lift of the hull so that the hull planes over the water at high speeds. Drag is generally minimized by decreasing the wetted area of the hull. However, decreasing drag and increasing lift usually adversely affects comfort and handling.

The invention solves the problem of obtaining high speeds without sacrificing a comfortable ride and good handling characteristics. A hull shape is provided which minimizes drag and maximizes speed while at the same time maintaining performance and handling characteristics. The hull is generally V-shaped, and the deadrise angle of the hull gradually increases from the stern to a point forward of the stern at the rate of about 2° to 6° for each four feet of keel length, or about ½° to 1½° for every foot of keel length. Tranverse cross sections of the hull between the stern and said forward point are generally convex. The hull may be provided with a truncated keel line and a relieved transom.

DESCRIPTION OF THE DRAWING

The invention will be explained in conjunction with an illustrative embodiment shown in the accompanying drawing, in which

FIG. 5 is an enlarged fragmentary view of a portion of FIG. 3;

FIG. 6 is a view similar to FIG. 5 showing a modified embodiment;

FIG. 7 is a bottom plan view of the hull showing the direction of water flow;

FIG. 8 is a sectional view taken along the line D–E of FIG. 7;

FIG. 9 is a view similar to FIG. 8 illustrating a prior art hull; and

FIG. 10 is a front view of the boat.

DESCRIPTION OF SPECIFIC EMBODIMENT

Figure 1:
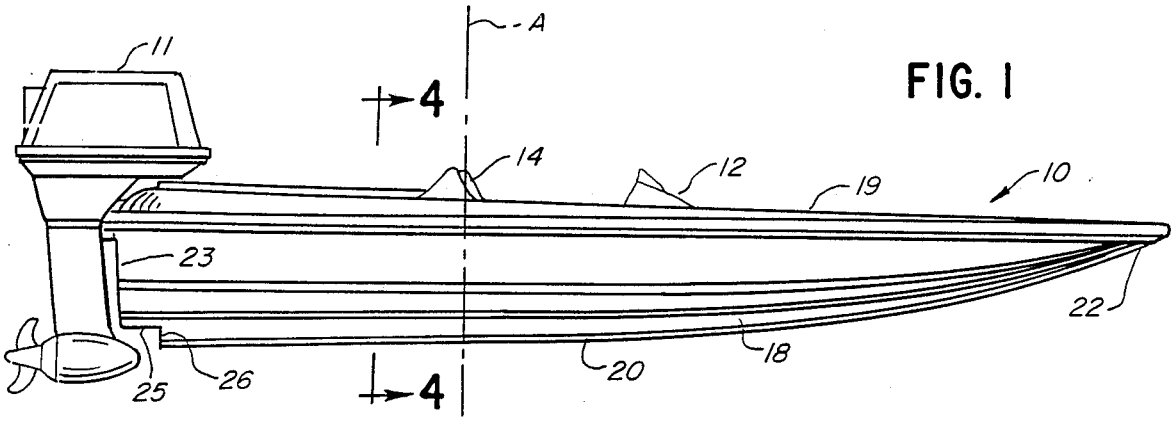
FIG. 1 is a side elevational view of a boat which is equipped with a hull in accordance with the invention.

The invention will be explained in conjunction with an outboard power boat 10 which is driven by an outboard motor 11. The particular boat illustrated is adapted for bass fishing and includes a console 12, driver seat 13, and passenger seat 14. It will be understood, however, that the invention is not limited to a particular kind of boat.

The boat 10 includes a hull 18 and a deck 19 which is secured to the hull. The hull includes a keel 20, a stern 21, and a bow 22. The hull is generally V-shaped in transverse cross section. The motor 11 is mounted on a transom 23 which extends downwardly adjacent the stern. The transom is relieved by a notched portion 24 which includes a forwardly extending portion 25 and a downwardly extending portion 26.

The bottom surface of the hull includes a keel pad 28 which extends laterally outwardly from the keel line 20, a pair of lift strakes 29 and 30, and pair of chines 31 and 32. The keel pad includes a V-shaped bottom surface 33 (FIG. 3) and a pair of generally vertical sides 34 and 35. Each of the lift strakes includes a generally horizontal bottom surface 36 and generally vertical side surface 37. Each of the chines includes a generally horizontal bottom surface 38 and a generally vertical side surface 39. If desired, one or more additional lift strakes can be provided on each side of the hull.

Referring to FIG. 1, the hull is provided with a truncated keel line. The keel line is substantially straight from the stern to vertical plane A forward of the stern. As will be explained hereinafter, the distance between the stern and the plane A is determined by the gross weight of the boat at the designed speed. For an outboard boat having a gross weight of 2400 pounds and a design speed of 60 mph, the forward plane A would be about 5 to 6 feet forward of the keel. Between the stern and plane A of the keel, the buttocks, strakes, and chines are all straight and flat with no rocker. The surface of the hull between the stern and the plane A defines the planing surface of the hull at planing speed.

Figure 3:
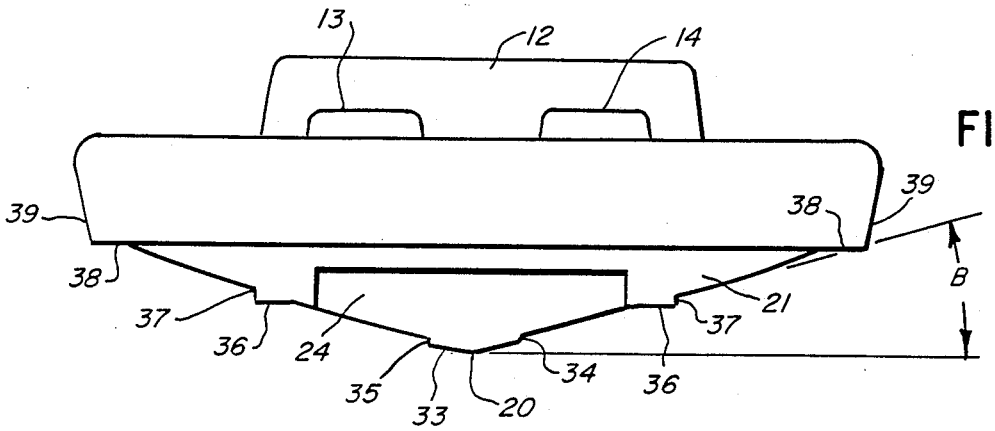
FIG. 3 is a rear end view of the boat without the motor.

Referring to FIG. 3, the V-shaped hull has a deadrise or dihiederal angle B at the stern. The deadrise angle is determined by the included angle between the bottom surface of the hull and the horizontal, disregarding the discontinuities in the bottom surface which are caused by the keel pad, lift strakes, and chines. In one specific embodiment of a 2400 pound boat with a design speed of 60 mph, the deadrise angle at the stern was 16° .

Figure 4:
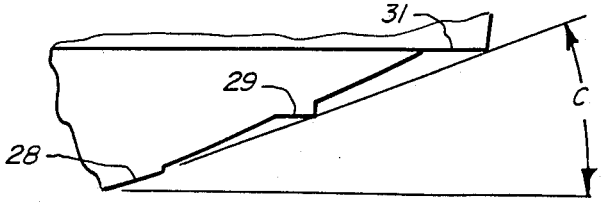
FIG. 4 is a sectional view taken along the line 4—4 of FIG. 1.

The deadrise angle progressively increases for transverse cross sections forward of the stern. FIG. 4 is a cross section of the hull at a point four feet forward of the stern. The deadrise angle C for the specific embodiment previously referred to was 20° , or 4° more than the deadrise at the stern. In accordance with the invention, the deadrise angle increases at the rate of about 2° to 6° for every four feet of keel length, or at the rate of about ½° to 1½° for every foot of keel length. Conventional boat designs generally provides for increasing the deadrise angle at about a rate of about 2° per foot of keel length.

Referring to FIG. 5, transverse cross sections of the bottom surface of the hull between the edge of the keel pad 28 and the strakes 29 and 30 and between the strakes and the chines 31 and 32 are convex rather than straight or concave. The bottom surface is convex in the planing surface from the stern to the forward plane A. A convex surface provides greater lift and enables the water to break away from the hull rather than ride up in contact with the hull.

The advantages of a convex cross section will be explained with reference to FIGS. 7–9. Referring first to FIG. 7, as the boat travels across the water, water travels from the keel line 20 toward the sides of the boat at an angle of about 6° to 7° , as indicated by dashed lines 42. The dotted lines 43 indicate the hull resistance, which establish the running attitude of the boat. Assume that the deadrise angle increases from 16° at the stern to 20° at a point D which is four feet forward of the stern. If the transverse cross section of the bottom surface of the hull was straight or concave, and if a straight edge was laid across the bottom surface from point D to point E at the intersection of the chine and stern, there would be a space between the straight edge and the bottom surface. This is illustrated in FIG. 9, which is a sectional view along the line D–E of a prior art hull in which transverse cross sections of the bottom surface are straight or concave. The bottom surface is seen to be concave in the cross section along the line D–E, and this concave surface provides a hollow or "hook" which provides greater drag and causes the bow of the boat to be pushed down.

If the transverse cross sections of the bottom surface are convex rather than straight or concave, then the hollow or hook shown in FIG. 9 is filled in and the bottom surface provides greater lift. This is shown in FIG. 8 in which the cross section of the bottom surface along the line D–E is straight and does not provide a hook. As the water travels in the directions indicated by the dashed lines 42 in FIG. 7, the bottom surface provides constant lift with the least amount of wetted surface. The optimum amount of convexity can be determined for each boat design by determining the amount of convexity which is necessary to provide a straight cross section along the line D–E.

The lift strakes 29 and 30 and the chines 31 and 32 are omitted from FIGS. 7–9 for clarity of illustration. Referring to FIG. 5, the portion of the convex bottom surface between the edge of the keel pad 28 and the strake 29 and the portion of the convex bottom surface between the strake 29 and the chine 31 follow the same curvature and have the same center as defined by a radius $R_1$. In the modified embodiment illustrated in FIG. 6, the convex bottom surface between the edge of the keel pad 128 and the strake 129 is defined by a radius $R_2$ from a first center, and the convex bottom surface between the strake 129 and the chine 131 is defined by a different radius $R_3$ from a second center.

A prior art boat with concave transverse cross sections in the aft planing area of the hull produces much greater wetted surface areas and requires more horse power per pound of hull to achieve the same speed as a hull formed in accordance with the invention. A typical prior art V bottom hull traveling at 60 mph will support about 185 to 200 pounds of hull weight per square foot of wetted surface. A hull formed in accordance with the invention will support about 225 to 235 pounds of hull weight per square foot of wetted surface at 60 mph. The forward plane A (FIG. 1) for a particular boat designed for a speed of 60 mph is determined by dividing the gross weight of the boat by 225 to determine the amount of wetted surface area needed to support the boat at 60 mph. This amount of wetted surface area determines the distance between the stern and the plane A at which the keel rises upwardly toward the bow.

In one embodiment of 20 foot outboard boat with a gross weight of 2400 pounds and designed for a speed of 60 mph, the plane A was about five to six feet forward of the stern. The boat achieved speeds of about 63 mph with a 150 horsepower motor and speeds of over 70 mph with a 220 horsepower motor.

The location of plane A was determined by dividing the boat weight by the factor of 225 to determine the amount of wetted surface needed to support the boat:

$$\frac{2400}{225} = 10.66 \text{ sq. ft.}$$

The width of the boat at the transom between the chines was 8 feet, and the length of the generally triangularly shaped wetted area is determined by the equation:

distance from transom to plane $A$ =

$$\frac{\text{wetted area}}{\frac{\text{width at transom}}{4}} = \frac{\frac{10.66}{8}}{4} = 5.33 \text{ feet}$$

Figure 2:
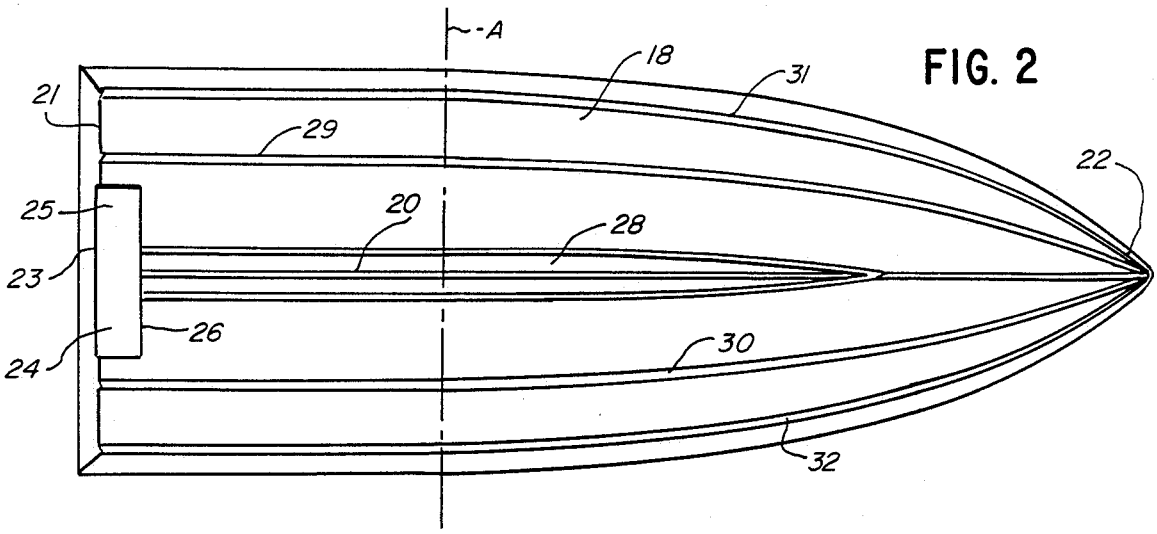
FIG. 2 is a bottom plan view of the boat without the motor.

The horizontal transom relief 25 (FIG. 2) is also determined by the gross weight of the boat, the desired wetted surface, and the design speed. In the aforementioned 20 foot 2400 pound boat, the horizontal transom relief was about 11 inches. The benefit attained with the transom relief is a reduction of the wetted surface area which enhances performance without reducing the length of the boat. A second benefit is effectively moving the outboard prop further aft of the stern end of the keel.

The foregoing design also provides a lower keel attack angle, i.e., the angle defined by the static water plane and the keel line. Prior boats normally have a keel attack angle of about 4° or more, and the specific embodiment of the invention previously described has a keel attack angle of about 3° . The lower keel attack angle provides a more nearly level motor trim, thereby providing a greater horizontal component of thrust and a lower vertical component of force which lifts the bow and which does not provide the most efficient thrust.

As previously stated, the preferred rate of increase of the deadrise angle for four feet of keel length is about 2° to 6° . If the angle increases more than 6° , the wetted keel line will be increased because of increased tail lift which drives the bow down. If the angle increases less than 2° , the amount of lift is reduced, thereby increasing the amount of wetted surface.

The boat hull described herein is advantageously made in the conventional manner by laying down resin-impregnated fiberglass in a gel-coated mold. Such a molding procedure is well known, and the details thereof need not be described herein. The angles and dimensions which are referred to in this specification include the normal manufacturing tolerances for molded fiberglass hulls.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A boat hull having a bottom surface which is generally V-shaped in transverse cross section, said bottom surface having a keel, a stern end and a bow end, said bottom surface further having a deadrise angle that progressively increases from said stern end to a vertical plane forward at said stern end, each transverse cross section of said bottom surface between said stern end and said forward vertical plane being convex, and wherein that portion of said bottom surface extending from a first location, corresponding to the intersection of said keel with said forward vertical plane, to a plurality of second locations, corresponding to the intersection of an edge of the bottom surface with said stern end, is shaped so that the lift to the hull is constant at any point along plural water travel lines, extending along the bottom surface of said hull from said first location to said plurality of second locations, which water travel lines are traversed by water during forward movement of said boat hull through the water.

2. A boat hull according to claim 1, wherein the shape of that portion of said bottom surface extending from said first location to said plurality of second locations defines a plurality of substantially straight lines therebetween.

3. A boat hull according to claim 1, wherein the bottom surface of said hull further includes a respective chine at each of lateral edges thereof, and a respective lift strake between said keel and a respective chine, each transverse cross section of the bottom surface between said stern end and said forward plane being convex between said keel and each lift strake, and between each lift strake and a respective chine, and wherein the shape of that portion of said bottom surface extending from said first location to a plurality of third locations, corresponding to intersections of said chines with said stern end, defines a plurality of substantially straight lines therebetween.

4. A boat hull according to claim 3, wherein said bottom surface between said keel and a respective said strake curves about a first center and said bottom surface between a strake and a respective said chine curves about a second center.

5. A boat hull according to claim 1, wherein said hull includes an offset transom which is positioned aft of the stern end of said keel and which includes a first downwardly extending portion adapted to support a motor and which terminates above said keel, a forwardly extending portion which extends forwardly from said first downwardly extending portion, and a second downwardly extending portion which extends downwardly from said forwardly extending portion to said keel.

6. A boat hull according to claim 5, wherein said forwardly extending portion of said transom is about 11 inches long.

7. A boat hull according to claim 1, wherein the deadrise angle of the bottom surface increases about 2 degrees to 6 degrees for each four feet of keel length from said stern end to said forward vertical plane.

8. A boat hull according to claim 7, wherein the deadrise angle of said bottom surface increases by about 4 degrees for each four feet of keel length.

9. A boat hull according to claim 1, wherein said keel includes a pad which extends below said bottom surface.

10. A boat hull according to claim 9, wherein the spacing of an edge of said pad below said bottom surface decreases from said stern end toward said bow end.

11. A boat hull according to claim 1, wherein the deadrise angle of said bottom surface is about 16 degrees at said stern end and about 20 degrees at a location four feet forward of said stern end.

12. A boat hull according to claim 1, wherein said keel is substantially straight from said stern end to said forward vertical plane and angles upwardly toward said bow end forwardly of said forward vertical plane.

13. A boat hull according to claim 12, wherein said forward vertical plane is located about five feet forward of said stern end for a 20 foot boat.

14. A boat hull according to claim 1, wherein the distance between said stern end and said forward vertical plane is such that, for a boat speed on the order of 60 mph, the wetted surface area of said bottom surface between said stern end and said forward vertical plane is equal to about the weight of the boat divided by 225 divided by about $\frac{1}{4}$ of the width of the boat at said stern end.

15. A boat hull having a bottom surface which is generally V-shaped in transverse cross section, said bottom surface having a keel, a stern end and a bow end, said bottom surface further having a deadrise angle that progressively increases from said stern end to a vertical plane forward of said stern end, each transverse cross section of said bottom surface between said stern end and said forward vertical plane being convex, and wherein that portion of said bottom surface extending from a first location, corresponding to the intersection of said keel with said forward vertical plane, to a plurality of second locations, corresponding to the intersection of an edge of said bottom surface with said stern end, is shaped so as to define a plurality of substantially straight lines therebetween, whereby lift to the hull is constant at any point along said substantially straight lines, said lines being traversed by water during forward movement of said boat hull through the water.

16. A boat hull according to claim 15, wherein said deadrise angle increases by about two to six degrees for each four feet of keel length from said stern end to said forward vertical plane.

* * * * *